United States Patent [19]

D'Alo

[11] 3,965,946

[45] June 29, 1976

[54] VACUUM DEVICE FOR AN EXPANDABLE CONTAINER

[75] Inventor: Herbert Fred D'Alo, Oakwood Hills-Cary, Ill.

[73] Assignee: Abbott Laboratories, North Chicago, Ill.

[22] Filed: Mar. 6, 1975

[21] Appl. No.: 555,763

[52] U.S. Cl. ..... 141/51; 128/214 D; 128/214 E; 141/114; 141/314; 141/369

[51] Int. Cl.[2] ..... B65B 3/04; B65B 3/16; B65B 31/09

[58] Field of Search ..... 141/51, 59, 7, 8, 10, 141/39, 65, 114, 314, 315, 316, 330, 369, 379; 128/DIG. 12, DIG. 14, 214 D, 214 F, 272, 276

[56] References Cited

UNITED STATES PATENTS

| | | | |
|---|---|---|---|
| 2,757,669 | 8/1956 | Gewecke et al. | 128/DIG. 12 |
| 2,999,500 | 9/1961 | Schurer | 128/DIG. 12 |
| 3,719,213 | 3/1973 | Quick | 141/5 |
| 3,722,557 | 3/1973 | Huggins | 141/59 |

*Primary Examiner*—Richard E. Aegerter
*Assistant Examiner*—Steven L. Stephan
*Attorney, Agent, or Firm*—Robert L. Niblack; Neil E. Hamilton

[57] ABSTRACT

A device which forms a closed compartment for an expandable container to permit a vacuum to be created around the flexible container so as to reduce the pressure inside the container and thereby permit the transfer of fluid materials into the expandable container. The vacuum device is simple in its construction in that it comprises a cover and base member forming a compartment which houses the expandable container and through which a vacuum line is interconnected. In a preferred manner, the cover has a pocket which supports the expandable container and positions it in a slanted manner such that a sealable inlet port is in a raised position as it extends through the cover. The cover member also has means to release the vacuum in the compartment. As a further embodiment, an electrical inlet and outlet are provided in the base which by means of a switch can operate a vacuum pump in conjunction with the opening and closing of the cover.

17 Claims, 6 Drawing Figures

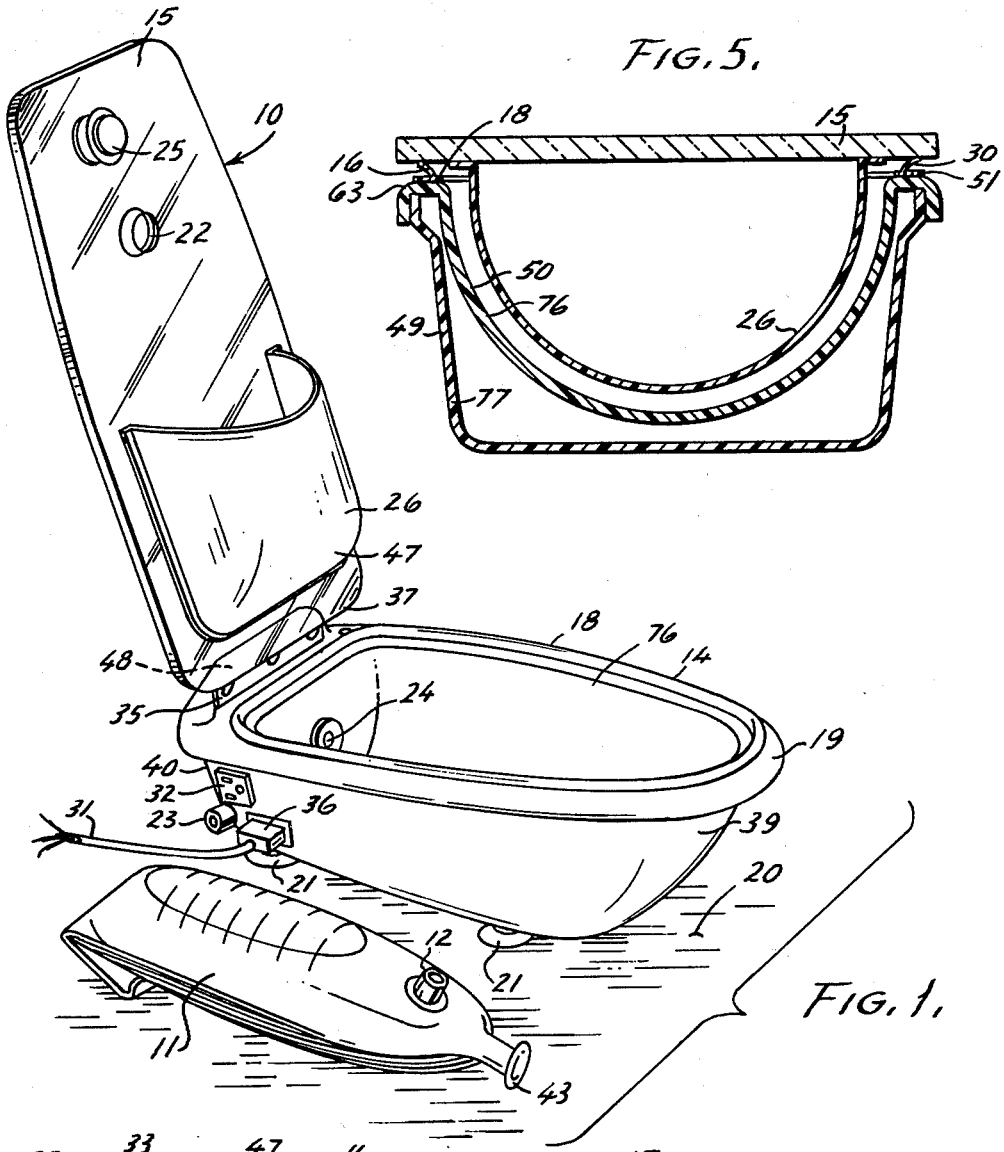
FIG. 5.
FIG. 1.
15
10
25
22
18
16
63
30
51
50
76
49
26
77
47
37
48
35
24
14
19
40
32
23
36
31
39
20
21
12
11
43
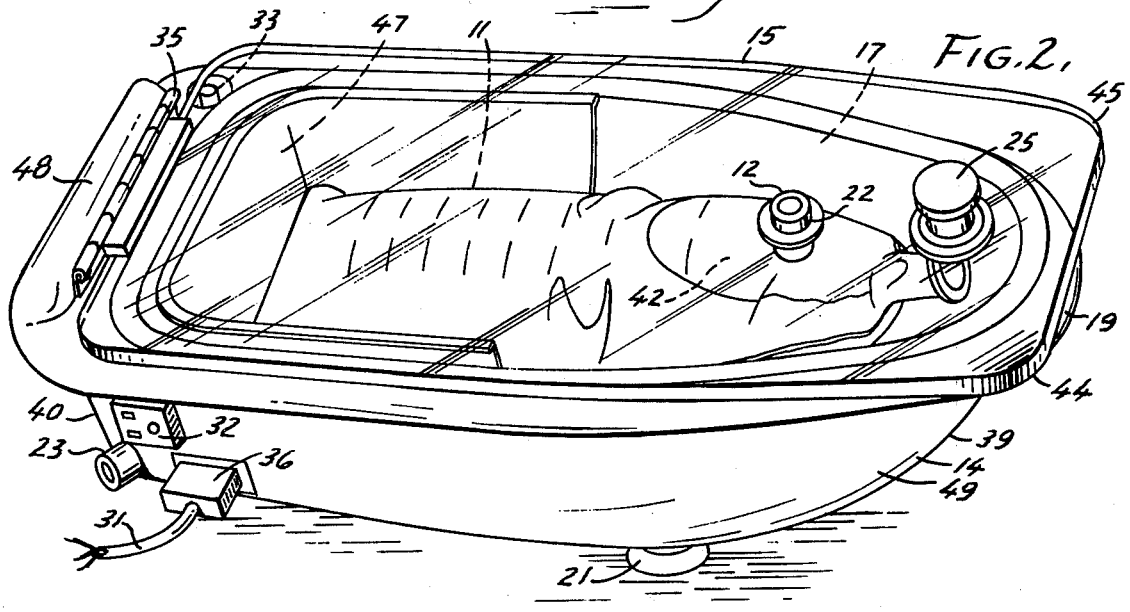
FIG. 2.
35
33
47
11
15
17
45
48
25
12
22
42
19
44
40
32
23
36
39
14
49
31
21

FIG. 3.
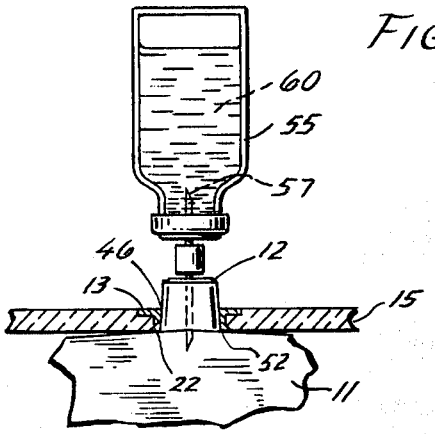
FIG. 4.
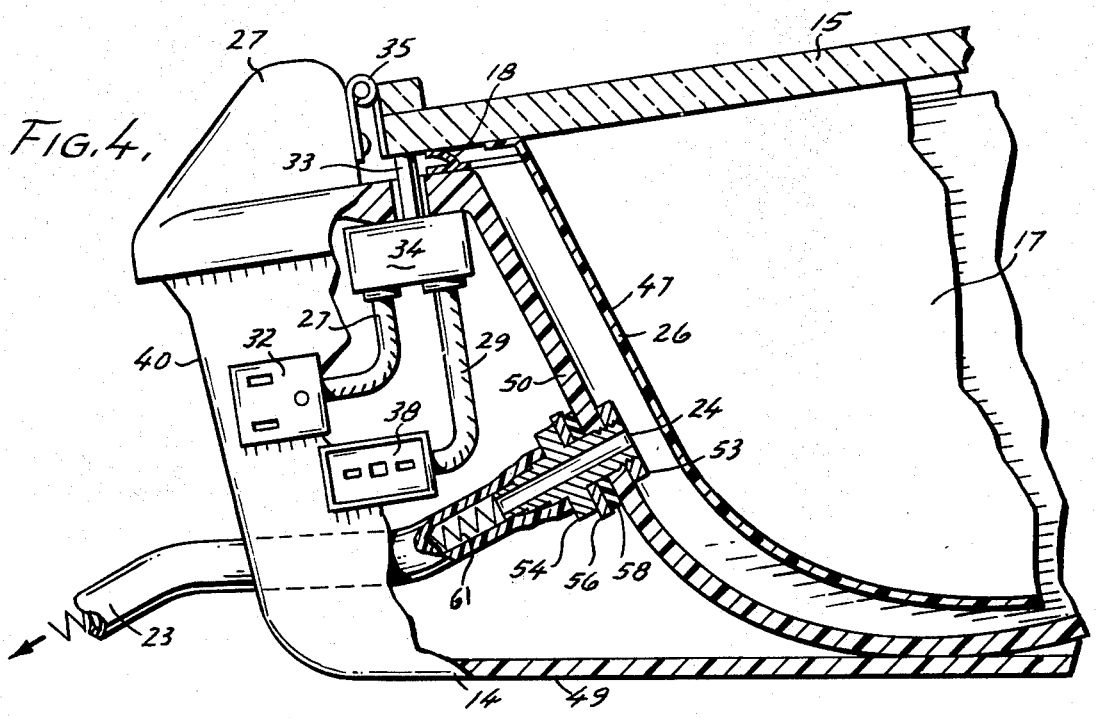
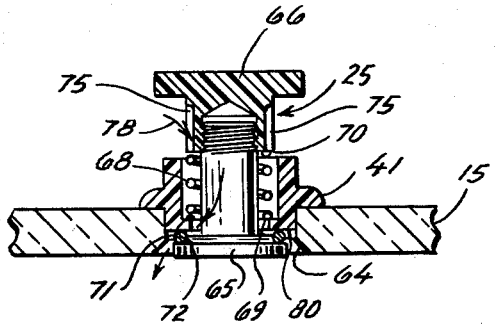
FIG. 6.

VACUUM DEVICE FOR AN EXPANDABLE CONTAINER

CROSS REFERENCE TO RELATED APPLICATIONS (None)

BACKGROUND OF THE INVENTION

This invention relates to a device for creating a vacuum around an expandable container. More particularly, it relates to an apparatus which aids in the introduction of a medicament into an expandable plastic container of parenteral fluid with the vacuum exerted on the expandable container causing it to expand and thereby effect the flow of the medicament into the parenteral fluid.

In the administration of parenteral fluids, it is often necessary to supplement the basic fluid with a further medicament such as prescribed by the attending physician. Many parenteral fluids are packaged in sealed, flexible containers having a sealable additive port. In order to introduce the medicament into the flexible solution container, the container would have to be squeezed in order to force air out of the bag and into a vial with the medicament to permit the medicament to enter the container upon release of pressure. These problems are referred to in U.S. Pat. Nos. 3,719,213 and 3,722,557. Another method for introducing medicaments into a flexible container or bag would be to have them first placed in a syringe and then forced by means of the syringe into the flexible bag. However, all of these previous methods are time consuming to perform or do not effect a complete transfer of the medicament into the bag. A solution to this problem is indicated by the device and process described in the previously mentioned prior art patents. However, the device indicated in U.S. Pat. No. 3,722,557 is costly to manufacture because of the numerous interconnecting ports which must be provided in a pivoting mechanism for the chamber which is interconnected to a vacuum or in the instance of U.S. Pat. No. 3,719,213, only a general description is given for a unit to perform a preferred method of transfer.

It is an advantage of the present invention to provide a novel device which will aid in the transfer of a medicament to an expandable plastic solution container which device can be manufactured from a minimum number of parts and yet can effect the transfer with a minimum number of procedural steps. Other advantages are a unit which will place the flexible container in a position so that the transfer is readily accomplished, a unit which can operate a vacuum pump in connection with the opening and closing of the cover and a unit wherein the vacuum is readily released without extensive manipulation of the chamber or cover.

SUMMARY OF THE INVENTION

The foregoing advantages are accomplished and the shortcomings of the prior art are overcome by the present device which has a base member constructed to accommodate an expandable container and a cover arranged with the base member to form a closed compartment around the expandable container. Sealing means are provided between the cover and the base so as to assure a vacuum which is introduced by means of a vacuum passage communicating with the compartment. The base member is secured to a support in a nonmovable manner and an opening is provided in the closed compartment to permit access to the sealable inlet port in the container. Means are provided in the closed compartment to release the vacuum once the medicament transfer is made. When using the device of this invention in conjunction with a vacuum pump, the vacuum pump does not shut off until the cover is raised and a microswitch interrupts the current to the pump motor. If some other vacuum source is employed, the vacuum is not discontinued even after the cover is raised. In a preferred embodiment, the vacuum release means is disposed in the cover and adjacent a portion of the flat cover member which extends outwardly from the wall of the base member so that one can grasp beneath the cover and place the thumb on the vacuum release mechanism for gripping support purposes. The vacuum release mechanism is positioned in the cover to make it possible to depress the top of the release mechanism while simultaneously lifting up on the cover. Also preferably, the cover member contains a pocket member which holds the expandable container in an inclined position with the high portion near the sealed inlet port and also holds the expandable container away from the vacuum inlet in the base member. If a vacuum pump is to be utilized in conjunction with the chamber, electrical connection means are provided in the base member and are operable with the cover so as to turn the vacuum pump off and on in connection with the opening and closing of the cover.

BRIEF DESCRIPTION OF THE DRAWINGS

A better understanding of the present device will be afforded by reference to the drawings wherein:

FIG. 1 is a perspective view of the vacuum device showing the cover in the open position and a flexible container positioned adjacent thereto.

FIG. 2 is a top view of the vacuum device shown in FIG. 1 with the flexible container accommodated therein and with the cover in the closed position.

FIG. 3 is a partial view in vertical section showing the introduction of a medicament into the flexible container within the vacuum device.

FIG. 4 is a partial view of the vacuum device in vertical section showing the electrical and vacuum utilities connected thereto.

FIG. 5 is a partial view in vertical section illustrating the double wall construction of the base member and its sealing engagement with the cover.

FIG. 6 is an enlarged partial view in vertical section illustrating the vacuum release mechanism.

DESCRIPTION OF THE PREFERRED EMBODIMENT

Proceeding to a detailed description of the present invention, the vacuum device generally 10 is designed to house an expandable, flexible container 11 having a sealable inlet port 12. The vacuum device is composed of a base member 14 and a substantially flat cover member 15 with the two members forming a closed compartment 17 (as best shown in FIG. 2) when the cover is in the closed position on the base member 14. A tight seal is afforded between the base 14 and cover 15 by means of sealing means 18 which is placed on the base member and completely surrounds it for engagement with the cover 15 as will be later explained. Base 14 is secured in a fixed or nonmovable position on a support 20, such as a table top (not shown) by means of suction cups 21.

It will be seen in FIGS. 1, 2 and 4 that a vacuum passage tube 23 extends through base 14 and is in communication with the inside of base 14 through vacuum inlet 24. Referring to cover 15, it will be seen that an opening 22 is provided which is designed to accommodate sealable inlet port 12 on flexible container bag 11 when the container is placed in the pocket member 26 also provided on the cover member. An annular metal insert 13 is disposed in opening 22 and has a straight walled portion 46 for engaging the tapered surface of additive port 12. A vacuum release means 25 is disposed on the cover and in a position away from the pocket member 26. Cover member 15 is attached to base 14 by means of hinge 35 which extends along a short side portion 37 of cover 15 as well as along the backwall 40 of base 14. It will be noted that base 14 has an upper rim 19 which above backwall 40 is upturned such as at 48 to provide a stop for cover 15 when it is in the fully opened position. Disposed in sidewall 49 and adjacent backwall 40 is a detachable electrical inlet cord 31 with plug 36. As best shown in FIG. 4, electrical current is supplied to outlet plug 32 by means of electrical switch 34 and wires 27 and 29 when plug 36 engages receptable 38. The purpose of having this electrical means is in those instances where a vacuum pump (not shown) would be employed to provide the vacuum in compartment 17. The inlet plug for the vacuum pump would be connected to plug 32 and cord 31 would be connected to an electrical outlet. Switch button 33 by means of switch 34 would then control the on-off mode of the pump with the switch being in the closed position when the cover is closed, such as in FIG. 2. Where a vacuum would be readily available, it would be interconnected to vacuum passage tube 23 rather than having tube 23 connected to the vacuum pump.

It will be seen in FIGS. 1 and 2 that the frontwall 39 of base 14 is higher than the backwall 40. This effects an inclination from the horizontal of the flexible container 11 when it is placed in pocket 26 of cover 15. This results in the placement of air pocket 42 in the flexible container adjacent opening 22 and sealable inlet port 12.

It should also be noted in conjunction with FIGS. 1 and 2 that the flexible container 11 is provided with the usual sealable outlet port 43. As best seen in FIG. 2, cover 15 has side portions 44 and 45 extending beyond the sidewalls such as 49 of the base. This affords a means of gripping the cover as well as placement of the fingers of one's hand under the cover so as to place the thumb on the vacuum release means 25 for easy raising of cover to the vertical position.

It should also be noted in conjunction with FIGS. 1 and 2 that pocket 26 in cover 15 has an endwall portion 47 against which will rest the end of the expandable, flexible container when in the inclined position inside compartment 17. This endwall 47 will be spaced from vacuum inlet 24 so as to prevent the flexible container from plugging the vacuum source when in the closed compartment 17. This is best shown in FIG. 4.

As will be seen in FIG. 4, base 14 houses between backwall 40 and inner wall 50 microswitch 34 with interconnected wires 27 and 29. Pushbutton switch 34 will thereby control the supply of electricity to the plug 32 as will be later explained in the operation.

As will be noted in FIGS. 4 and 5, base member 14 is in effect formed from an outer wall portion 49 and an inner wall portion 50, with inner wall 50 extending toward the back or end of the unit wherein there is disposed vacuum inlet 24. Vacuum line 23 is secured to inner wall 50 by means of threaded locknut 53 engaging a barbed adapter 54 with metal washer 56 and rubber washer 58 disposed therebetween. Spring 61 is internally housed in vacuum line 23 as a strain relief to prevent the line from splitting upon bending. As will be particularly noted in FIG. 5, inner wall 50 extends upwardly and over outer wall 49 and there is placed thereon a single flexible strip of silicone rubber 16 to provide a gasket-type sealing means 18. The extruded silicone rubber gasket material 16 has a substantially Y-shaped cross-section when not compressed in a sealing position. When it is compressed between cover 15 and the top portion 63 of wall 50, the upper arm 30 will close toward lower arm 51.

The vacuum release means is particularly described in FIG. 6. It is composed of an annular collar 41 frictionally engaged in opening 64 of cover 15. A T-shaped threaded stem 65 is disposed in collar 41 and is attached to thumb button 66. A spring 68 is carried around stem 65 and rests against annular ledge 69 on collar 41 and the annular endwall 70 of button 66. A seal 71 is provided between stem 65 and collar 41 by means of rounded washer 72. It will be seen that lateral slots 75 are provided in button 66 for purposes as will be later explained in the operation.

OPERATION

A better understanding of the advantages of vacuum device 10 will be had by a description of its Operation. The expandable container will be in the form as indicated by numeral 11 and will be composed of a flexible plastic bag containing a parenteral solution. Often it is desirable to add a further medicament to this solution prior to administration to the patient. To effect this, it is expedient to form a vacuum around the flexible container. This causes the air to expand within the flexible container and thereby creates a partial vacuum. The pressure differential between the air in the partially filled medicament vial and partial vacuum in the flexible container causes the medicament to transfer via the double-ended needle into the flexible container. This is easily facilitated by vacuum device 10 in that the operator positions bag or expandable container 11 into pocket member 26 when the cover 15 is in the open position as shown in FIG. 1. Sealable inlet port 12 will be inserted through opening 22 in cover 15 and will be snugly held therein by means of a tapered fit 52 on port 12 and the straight walled opening 22, as is best seen in FIG. 3. A vacuum pump with an inlet plug (not shown) will then be connected into outlet 32 with electrical inlet wire 31 suitably connected to an A.C. electrical source and plug 36 inserted in receptacle 38. Vacuum passage tube 23 will be attached to the intake side of the vacuum pump. Upon closing of lid 15 onto base 14 switch 34 will be closed so as to activate the vacuum pump thereby evacuating the closed compartment 17 by means of a vacuum being drawn through vacuum passage 23 and vacuum inlet 24. As the vacuum is drawn on compartment 17, container 11 will expand. A solution vial 55 with a double needle transfer device 57 will then be inserted through sealable inlet port 12. With the reduction of pressure in expandable container 11, the fluid medicament 60 will readily flow through the needle or cannula 57 and into container 11. After the desired quantity of medicament 60 is placed inside expandable container 11, the cannula 57 is withdrawn.

It will be noted that the frontwall 39 of base 14 extends higher than does the backwall 40. This effects an inclination of flexible container 11 inside compartment 17 in the area of the inlet port 12 when the cover 15 is in the closed position. This is best seen in FIG. 2 and results in the air pocket 42 being positioned directly beneath sealable inlet port 12. The purpose of the air pocket is to verify and monitor the entry of the fluid medicament 60 into flexible container 11. To release the vacuum in compartment 17, all that is required is the placement of one's fingers under extensions 44 and 45 of cover 15 with a thumb or thumbs on vacuum release means 25. A depression of the vacuum release means 25 will cause air to enter into compartment 17 as it will flow along lateral slots 75 in button 66, between collar 41 and stem 65, seal 71 and the endwall 80 of collar 41, as generally indicated by arrow 78 in FIG. 6, when stem 65 is moved away from endwall 80. Cover 15 can then be lifted. Upon lifting, button 33 of switch 34 will be extended thereby opening the switch and cutting off current to the vacuum pump motor and consequently any vacuum to the inside of compartment 17.

Where a vacuum source is readily available such as an in-house piped vacuum supply, the vacuum pump connection and the electrical connections through plugs 32 and 36 can be dispensed with, with the vacuum being connected directly to vacuum passage 23. The placement of the flexible container in compartment 17 will be as previously described as well as the release of vacuum by means of vacuum release means 25. Irrespective of which source of vacuum is utilized, it will be recognized that the solution container 11 is readily placed in the optimum position inside compartment 17 with respect to opening 22 with effective sealing being caused by the closing of arms 30 and 51 of sealing means 30 in contact with cover 15 and top portion 63. Further ready release of the vacuum is accomplished by vacuum release means 25.

The preferred material for forming the strip 16 of sealing means 18 is Dow Corning silicone rubber, 4600-70 durometer. The base 14 is formed from an opaque Marbon ABS plastic material with the inside wall 50 formed from 0.250 inch thick material with a 0.003 inch acrylic cladding. The outer wall or shell 49 is fabricated from the 0.187 inch thick ABS material and has an acrylic cladding of 0.003 inch. Cover 15 is formed from ⅜ inch acrylic plastic and is transparent. Obviously, other resinous plastic, glass or metallic material could be substituted for base 14 and cover 15.

As indicated above, electrical inlet wire 31 with plug 36, outlet plug 32 and switch 34 are not essential features in every application and can be eliminated or not utilized where a source of vacuum can be connected directly to vacuum passage 23. Base member 14 is formed from two wall members 49 and 50 which in effect form an inner base hollowed member 76 and an outer hollowed member 77. The top 63 of wall 50 is formed as a beam which adds rigidity to the inner base member 76. If desired, a single wall construction could be utilized with the provision that it not collapse under vacuum conditions. Cover 15 is designed with overextending edges 44 and 45 for purposes of engagement with the fingers to aid in depressing vacuum release 25. These could also be eliminated and the cover 15 made coextensive with the periphery of base 14. Vacuum release means 25 is positioned in cover 15. Alternatively, it could be placed in base 14 although its operation would not be as convenient.

It will thus be seen that through the present invention there is provided a vacuum device for an expandable container which is composed of a minimum number of parts yet is operable with a minimum amount of effort. A flexible container is readily positioned inside the chamber with the air pocket for receiving the additional medicament being placed directly beneath the resealable inlet port. The unit of this invention is readily adaptable to either an inside house vacuum source or can control a vacuum pump. The vacuum is readily releasable with a minimum amount of effort by the operator.

The foregoing invention can be practiced by those skilled in the art. Such skilled persons will know that the invention is not necessarily restricted to the particular embodiments presented herein. The scope of the invention is to be defined by the terms of the following claims as given meaning by the preceding description.

I claim:

1. A device for introducing a flowable material into an expandable container having a sealable inlet port comprising:

a base member constructed and arranged to accommodate said container therein;

a cover member;

pivoting means securing said cover member to said base member to define a closed compartment;

sealing means disposed between said base and cover members, said base member adapted to be secured to a support in a stationary position and to remain in said position throughout usage of said device;

an opening in said cover member to permit access to said sealable inlet port in said container;

a vacuum passage communicating from inside said compartment to the outside;

a pocket member carried by said cover to position said sealable inlet port in said opening in said cover and to fully support said container when in a substantially vertical position, said pocket member partially supporting said container when in a substantially horizontal position;

and means carried by said cover member or said base to release a vacuum in said compartment.

2. The vacuum device as defined in claim 1 wherein said sealing means comprises a single substantially Y-shaped strip of pliable material.

3. The vacuum device as defined in claim 1 wherein said means to release the vacuum in said chamber is carried by said cover and is a valve member which when depressed effects communication between the outside atmosphere and the compartment.

4. The vacuum device as defined in claim 1 further including an electrical inlet and an outlet plug carried by said base member and a switch disposed between said inlet and outlet plug, said switch constructed and arranged to be contacted by said cover.

5. The vacuum device as defined in claim 4 wherein said cover member and said base have shorter side portions and said cover member is pivotally attached to said base member by means of a hinge disposed along one of the shorter side portions of said cover and said base members.

6. The vacuum device as defined in claim 1 wherein said pocket, cover and base members are constructed and arranged to position said expandable container in an inclined position with the portion of said container having said inlet port positioned at the higher dimension.

7. The vacuum device as defined in claim 6 wherein said base member has a front and backwall portion constructed and arranged with a higher frontwall than the backwall and said opening in the closed compartment is defined in said cover and disposed adjacent the higher frontwall of said base member when said cover is positioned in a closed position on said base.

8. The vacuum device as defined in claim 1 wherein said cover member is composed of a flat, rigid, transparent material and said base member is formed from two separate wall portions.

9. The vacuum device as defined in claim 1 wherein said cover is constructed and arranged to extend beyond at least a portion of the sidewall of said base member.

10. The vacuum device as defined in claim 1 wherein said base member is defined by a wall member constructed and arranged with an upper beam portion.

11. A vacuum device for introducing a sterile, flowable material into a sterile, closed, expandable container having a sealable additive port comprising:

a base member having means to secure the base member in a stationary position on a supporting surface and to remain in said position throughout usage of said device, said base member having an end portion and constructed and arranged to receive said expandable container therein;

a vacuum passage and electrical connection means housed in said base member in the same end portion with said vacuum passage having an inlet into the inside of base member;

a cover member having an opening for accommodating said sealable additive port of said expandable container;

means to temporarily seal said cover and base members together;

hinging means connecting said cover and base members together adjacent said end portion of said base member;

a pocket member carried by said cover adjacent the portion of said cover hinged to said base member; to fully support said container when in a substantially vertical position and at least partially support said container when in a substantially horizontal position;

an electrical switch interconnecting said electrical connection means and disposed adjacent said hinging means whereby movement of said cover member actuates said switch.

12. The vacuum device as defined in claim 11 wherein said pocket has an endwall to retain said expandable container away from the vacuum inlet.

13. The vacuum device as defined in claim 11 wherein said opening in said cover for receiving said additive port is straight walled and said additive port is tapered.

14. The vacuum device as defined in claim 11 further including a vacuum release means disposed in said cover and opposite said pivotal means, said cover constructed to extend beyond the confines of the sidewall of said base with said extending portion and said vacuum release means disposed within the grasp of a human hand.

15. The vacuum device as defined in claim 11 wherein said cover is substantially flat and said base has an endwall of higher dimension than the wall portion housing said vacuum passage and said electrical connection means.

16. The vacuum device as defined in claim 15 wherein said cover is composed of a transparent plastic material and said base is composed of an opaque plastic material.

17. The vacuum device as defined in claim 11 wherein said sealing means is carried only by said base member and said cover member is substantially flat.

* * * * *